US006587571B1

(12) United States Patent
Fujihira et al.

(10) Patent No.: US 6,587,571 B1
(45) Date of Patent: Jul. 1, 2003

(54) SPEAKER

(75) Inventors: Masao Fujihira, Kanagawa (JP); Ikuo Shinohara, Tokyo (JP); Kenji Tokushige, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/574,034

(22) Filed: May 18, 2000

(30) Foreign Application Priority Data

May 19, 1999 (JP) ..... 11-138948

(51) Int. Cl.[7] ..... H04R 25/00
(52) U.S. Cl. ..... 381/407; 381/401
(58) Field of Search ..... 381/396, 400, 381/407–410, 420, 401–402

(56) References Cited

U.S. PATENT DOCUMENTS

| | | | | | |
|---|---|---|---|---|---|
| 2,007,748 | A | * | 7/1935 | Olson | 181/174 |
| 2,769,942 | A | * | 11/1956 | Hassan | 123/196 S |
| 2,925,541 | A | * | 2/1960 | Koch | 335/299 |
| 3,792,394 | A | * | 2/1974 | Bertagni | 335/299 |
| 4,061,890 | A | * | 12/1977 | Froeschle | 381/407 |
| 4,088,847 | A | * | 5/1978 | Yukimoto et al. | 381/400 |
| 4,115,667 | A | * | 9/1978 | Babb | 381/396 |
| 4,225,756 | A | * | 9/1980 | Babb | 29/605 |
| 4,341,930 | A | * | 7/1982 | Steinle et al. | 381/396 |
| 4,483,015 | A | | 11/1984 | Strohbeen | |
| 4,504,704 | A | | 3/1985 | Ohyaba et al. | |
| 5,014,321 | A | | 5/1991 | Klein | |
| 5,533,134 | A | * | 7/1996 | Tokura et al. | 381/401 |
| 5,740,265 | A | | 4/1998 | Shirakawa | |
| 6,385,328 | B1 | * | 5/2002 | Yoo et al. | 381/409 |

FOREIGN PATENT DOCUMENTS

| | | | |
|---|---|---|---|
| DE | 3844702 A1 | * | 4/1991 |
| GB | 2064266 | | 6/1981 |

* cited by examiner

*Primary Examiner*—Rexford Barnie
*Assistant Examiner*—P. Dabney
(74) *Attorney, Agent, or Firm*—Jay H. Maioli

(57) ABSTRACT

In a speaker which is constructed in a manner that a voice coil bobbin is attached to an inner circumferential portion of a cone type diaphragm while a voice coil is wound around the voice coil bobbin, and the voice coil is inserted into a magnetic gap, the voice coil bobbin is formed of a conductive material and is provided with a gap extending a lengthwise direction so as to form a one-turn voice coil, and the voice coil is fixed to the voice coil bobbin by a soft bonding agent while a very high frequency audio signal is supplied to the one-turn voice coil forming the voice coil bobbin.

1 Claim, 7 Drawing Sheets

SPEAKER

BACKGROUND OF THE INVENTION

1. Field of the Invention

The present invention relates to a wide-band reproducing speaker which can reproduce a very high sound band up to 70 kHz, for example.

2. Description of the related Art

In general, a whole band speaker having a small aperture (diameter), for example, an aperture of 39 mm, is constructed in a manner that a voice coil bobbin is attached to an inner circumferential portion of a cone type diaphragm while a voice coil is wound around the voice coil bobbin, and the voice coil is inserted into a magnetic gap. However, in the above speaker, it is difficult to reproduce (radiation) a very high sound band, and further, a reproducing sound band by the speaker is up to 40 kHz to the utmost from the reason why a weight of the voice coil is heavy.

The present invention has been made in view of the above problem. It is, therefore, an object of the present invention to provide a cone type speaker which can reproduce a very high sound band up to 70 kHz, for example.

SUMMARY OF THE INVENTION

To achieve the above object, the present invention provides a speaker which is constructed in a manner that a voice coil bobbin is attached to an inner circumferential portion of a cone type diaphragm while a voice coil is wound around the voice coil bobbin, and the voice coil is inserted into a magnetic gap, characterized in that the voice coil bobbin is formed of a conductive material while the voice coil bobbin is provided with a gap extending a lengthwise direction so as to form one-turn voice coil, and the voice coil is fixed to the voice coil bobbin by a soft bonding agent while a very high frequency audio signal is supplied to one-turn voice coil comprising the voice coil bobbin.

According to the present invention, the voice coil bobbin comprises as one-turn voice coil while a very high frequency audio signal is supplied the voice coil, and the voice coil is fixed to the voice coil bobbin by a soft bonding agent. In a very high sound band, a bonding force by the soft bonding agent lowers, and then, the voice coil bobbin and the voice coil become a state of separating from each other. Therefore, the voice coil bobbin is operated as one-turn voice coil, and then, a diaphragm is vibrated by only very light voice coil bobbin, and thereby, the voice coil before separating from the voice coil bobbin has no mass. As a result, by a difference in mass, it is possible to a very high sound band up to 70 kHz, for example.

DESCRIPTION OF THE PREFERRED EMBODIMENTS

Embodiments of a speaker according to the present invention will be described below with reference to FIG. 1 and FIG. 2.

Figure 2:
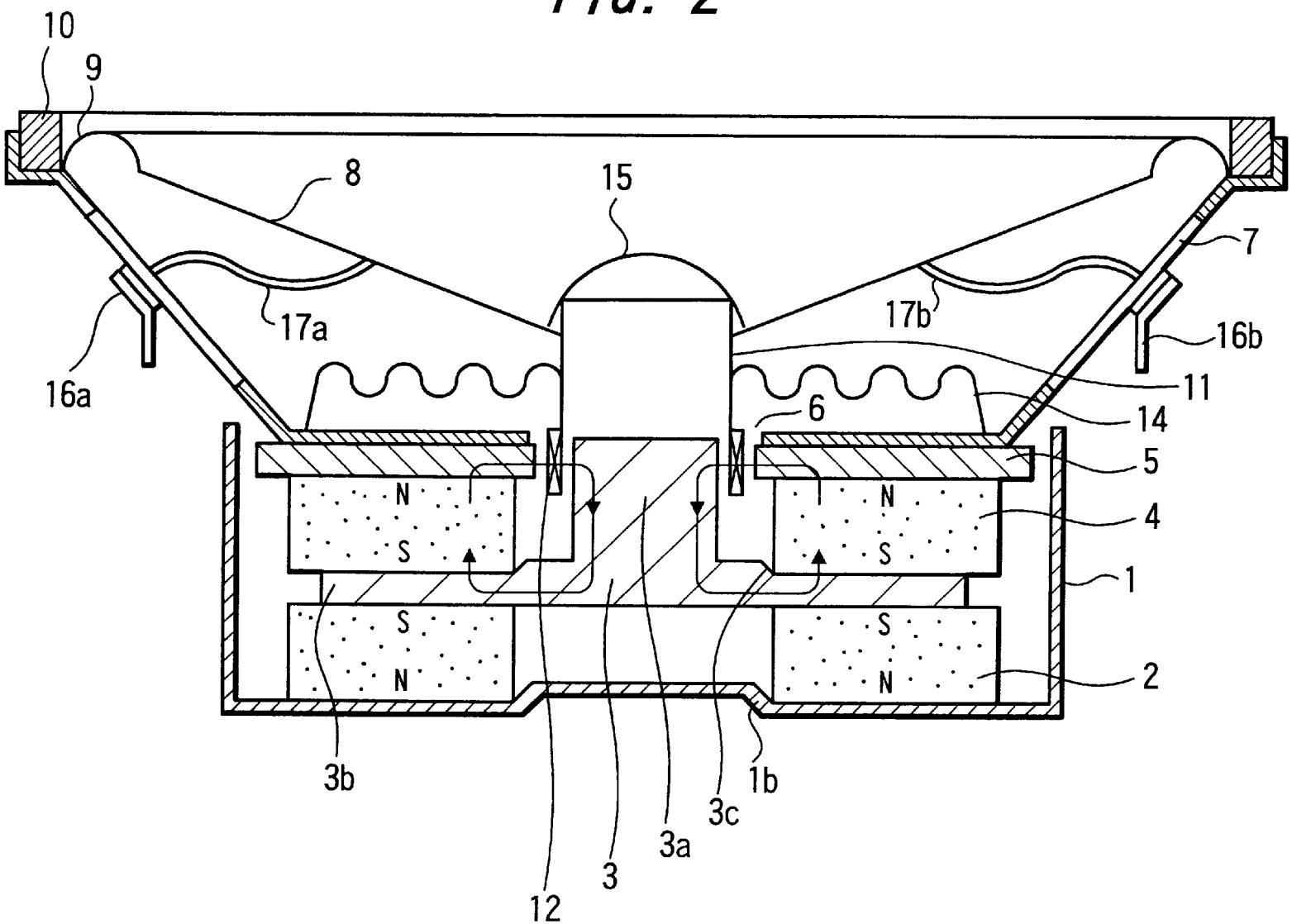
FIG. 2 is a cross sectional view showing an embodiment of the speaker of the present invention.

As shown in FIG. 2, a ring-like magnet 2 has an N pole and an S pole which are magnetized in a thickness direction on a bottom portion 1*a* of a pot-shaped shield cover 1 having a predetermined size, and the ring-like magnet 2 is bonded and fixed so that the N pole is abutted against the bottom portion 1*a* of a pot-shaped shield cover 1. In this case, the ring-like magnet 2 is positioned by a magnet guide 1*b* provided on the bottom portion 1*a* of the pot-shaped shield cover 1.

A yoke 3 is constructed in a manner that a center pole 3*a* and a flange 3*b* are integrally formed, and the yoke 3 is fixed on the S pole of the ring-like magnet 2 so that a bottom surface of the flange 3*b* of the yoke 3 is abutted against the S pole.

Further, a ring-like magnet 4 has an N pole and an S pole which are magnetized in a thickness direction on the flange 3*b* of the yoke 3, and the ring-like magnet 4 is bonded and fixed so that the S pole is abutted against the flange 3*b* of the yoke 3. In this case, the center pole 3*a* of the yoke 3 penetrates through the ring-like magnet 4, and then, the ring-like magnet 4 is positioned by a magnet guide 3*c* provided on the flange 3*b* of the yoke 3.

A ring-like plate 5 is bonded and fixed on the N pole of the ring-like magnet 4 so that a magnetic gap 6 is formed between an inner peripheral surface of the plate 5 and an outer peripheral surface of the center pole 3*a*.

In this case, these ring-like magnets 2 and 4 are mutually magnetized in a reverse direction, and then, the ring-like magnet 2 is operated as a cancel magnet while the pot-like shield cover 1 covers the outer periphery of the ring-like magnets 2 and 4, and thereby, a magnetic shield type speaker is constructed.

Moreover, a speaker frame 7 is attached to an upper surface of the plate 5, and then, a cone type diaphragm 8 having an edge 9 at its outer periphery is retained to an outer peripheral portion of the frame 7 by a gasket 10.

On the other hand, a voice coil bobbin 11 is attached to an inner peripheral portion of the diaphragm 8, and then, a voice coil 12 is wound around the voice coil bobbin 11 while being bonded and fixed thereto. Further, the voice coil 12 is inserted into the magnetic gap 6 formed between the inner peripheral surface of the plate 5 and the outer peripheral surface of the center pole 3*a* of the yoke 3.

Figure 1:
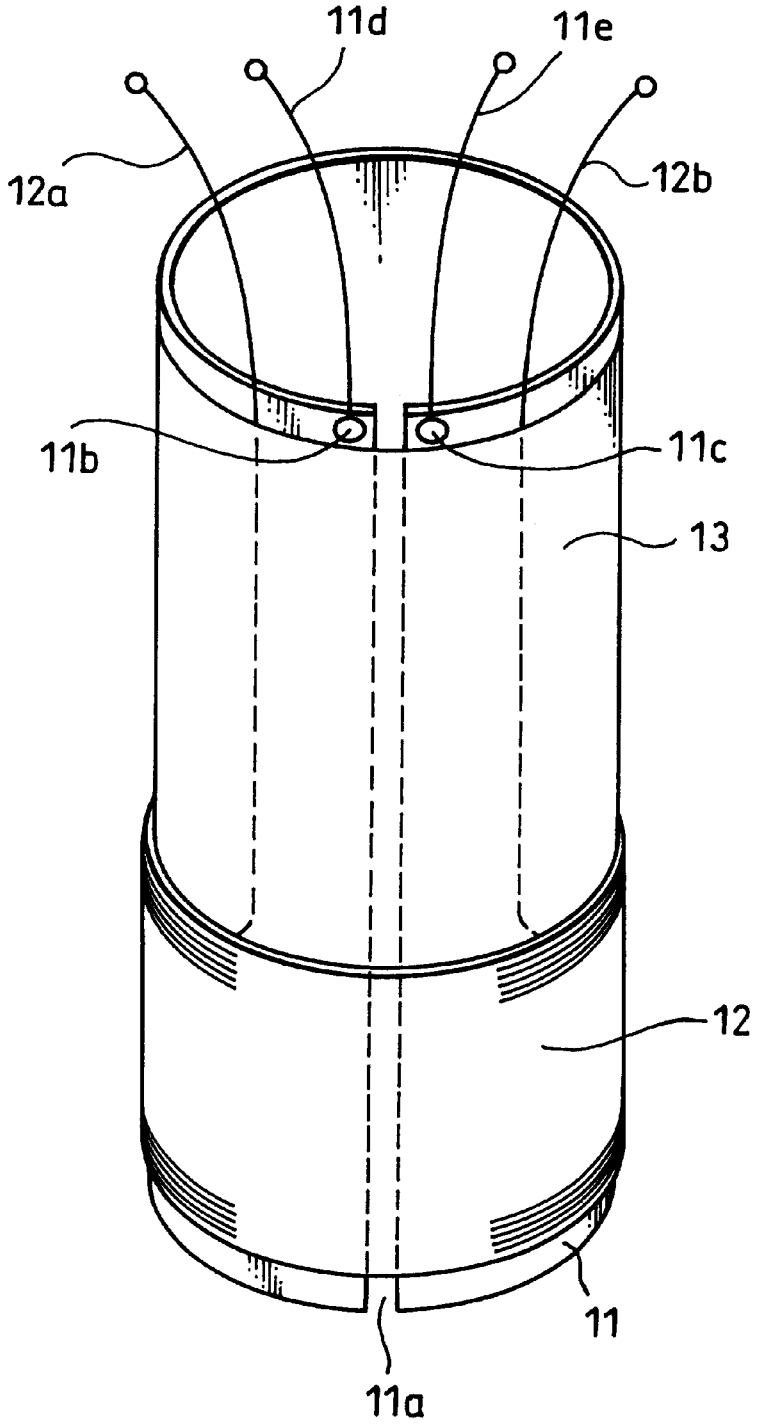
FIG. 1 is a perspective view showing an example of a voice coil used in a speaker of the present invention.

In this embodiment, as shown in FIG. 1, the voice coil bobbin 11 is formed of a conductive material, e.g., an aluminum sheet (thin film), and is formed with a gap 11*a* extending to a lengthwise direction so as to construct a non-conductive portion. Further, the voice coil bobbin 11 is constructed as one-turn voice coil, and the voice coil 11 is provided with input terminals 11*b* and 11*c* at one and the other ends thereof, and further, a very high frequency audio signal such as an acoustic signal is supplied to the input terminals 11*b* and 11*c*. In FIG. 1, reference numerals 11*d* and 11*e* are individually lead wires of the input terminals 11*b* and 11*c*.

A reinforcing paper 13 for reinforcing the voice coil bobbin 11 is wound around the outer periphery of the voice coil bobbin 11 comprising an aluminum thin film, and then, the voice coil 12 is wound around the voice coil bobbin, and further, is bonded and fixed thereto. In FIG. 1, reference numerals 12*a* and 12*b* are individually voice coil lead wires for supplying an acoustic signal of the voice coil 12.

In this embodiment, a soft bonding agent is used as a bonding agent for bonding and fixing the voice coil 12 to the voice coil bobbin 11. An alcoholic reactivated bonding agent such as a rock varnish is used as the soft bonding agent.

Moreover, as shown in FIG. 2, the voice coil 12 is retained in the magnetic gap 6 by a damper 14. A spiral damper is used as the damper 14, and is constructed in a manner that, e.g., a cloth is impregnated with a synthetic resin. Further, the voice coil bobbin 11 is provided with a dustproof cap 15 at its upper surface.

Input terminals 16*a* and 16*b* are provided on a predetermined position of the speaker frame 6, and then, an acoustic signal supplied to the input terminal 16*a* is supplied to the voice coil 12 via a cotton-covered wire 17*a* while a very high frequency audio signal such as an acoustic signal supplied to the input terminal 16*b* is supplied to one-turn voice coil comprising the voice coil bobbin 11 via a cotton-covered wire 17*b*.

Figure 3:
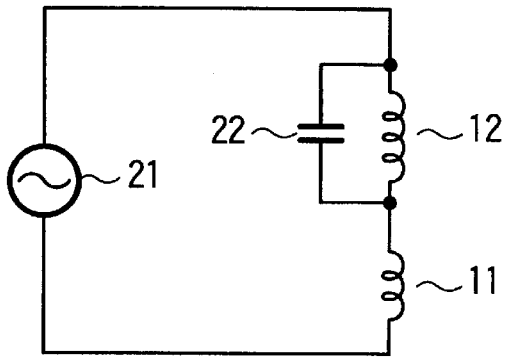
FIG. 3 is a view to explain a connection of the present invention.

In this embodiment, in the case of supplying an acoustic signal 21 to the voice coil 12 and one-turn voice coil comprising the voice coil bobbin 11, as shown in FIG. 3, the voice coil 12 is connected in series with one-turn voice coil 11 comprising the voice coil bobbin, and is connected in parallel with a high-pass capacitor 22, and further, the acoustic signal 21 is supplied to a parallel circuit comprising the voice coil 12 and the capacitor 22 and to a series circuit of one-turn voice coil 11 comprising the voice coil bobbin.

In this case, one-turn voice coil 11 has a very low resistance value; however, one-turn voice coil 11 is connected in series to the voice coil 12, and thereby, it is possible to omit a matching transformer for matching an impedance.

Figure 4:
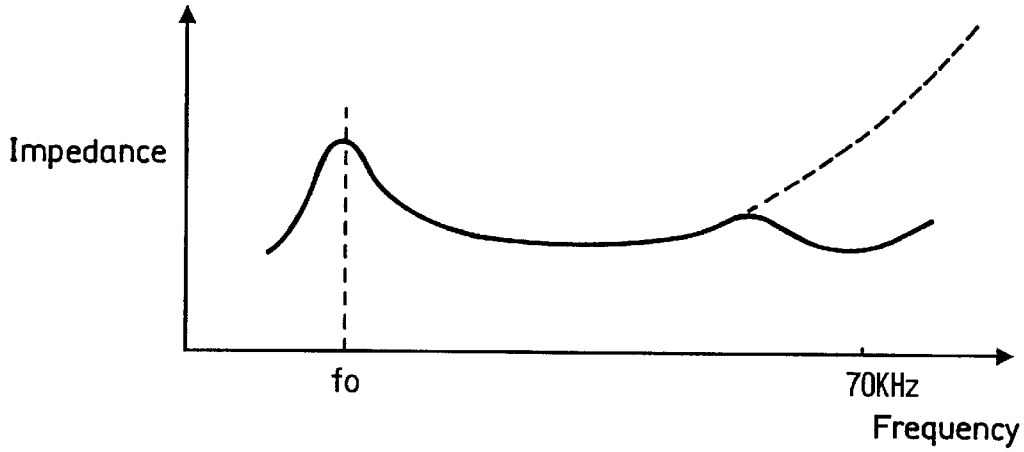
FIG. 4 is a diagram to explain the present invention.

Moreover, the capacitor 22 is connected in parallel with the voice coil 12, and thereby, as shown in FIG. 4, an impedance of the voice coil 12 portion is made small, and a current inputted to one-turn voice coil 11 is made large, and thus, it is possible to make large a driving force of the voice coil 11 in a very high an ultra-high frequency audio signal sound band.

For example, in an 8-ohm speaker, the resistance value is about 30 ohms in 20 kHz, and therefore, it becomes 150 ohms in 100 kHz. However, the capacitor 22 is connected in parallel with the voice coil 12, and a synthetic impedance at 100 kHz is set so as to become 6 ohms, and thereby, the impedance of the voice coil 12 portion becomes 6 ohms/150 ohms=1/25. For example, when an impedance of the one-turn voice coil 11 at 100 kHz is set to 2 ohms, each impedance of the parallel circuit comprising the voice coil 12 and the capacitor 22 and the series circuit comprising one-turn voice coil 11 is set to 8 ohms.

In this case, a current flowing through one-turn voice coil 11 becomes 19 times=(150 ohms +2 ohms)/(6 ohms +2 ohms), and then, a driving force of one-turn voice coil 11 increases by 19 times of the current, and therefore, a sound pressure at a very high an ultra-high frequency audio signal sound band 100 kHz is greatly improved to about 25 dB. In other words, even if the sound pressure is reduced to about 25 dB, it becomes a flat sound pressure level.

In the speaker shown in FIG. 2, a magnetic flux of the N pole of the ring-like magnet 4 flows through the following magnetic circuit of; more specifically, the N pole of the ring-like magnet 4→the plate 5→the magnetic gap 6→the center pole 3*a* of the yoke 3→the flange 3*b* the S pole of the ring-like magnet 4.

Therefore, when an acoustic signal is supplied from the input terminal 16*a* to the voice coil 12, in response to the acoustic signal, the voice coil 12 is driven so as to drive the diaphragm 8. In this case, the diaphragm 8 is driven by the voice coil 12 up to about 40 kHz.

Figure 5:
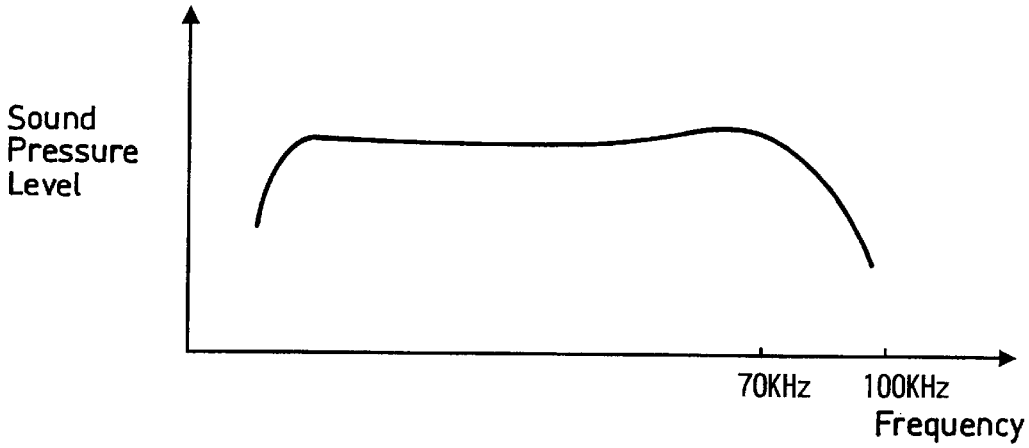
FIG. 5 is a diagram to explain the present invention.

In this embodiment, the voice coil bobbin 11 is formed of a conductive material, e.g., an aluminum thin film (sheet), as one-turn voice coil, and a high-pass signal of the acoustic signal is supplied thereto, and further, the voice coil 12 is fixed to the voice coil bobbin 11 by a soft bonding agent. For example, in a very high an ultra-high frequency audio signal sound band of 40 kHz or more, a bonding strength of the soft bonding agent lowers; as a result, the voice coil bobbin 11 and the voice coil 12 become a state of separating from each other. At this time, the voice coil bobbin 11 is operated as one-turn voice coil, and the diaphragm 8 is vibrated by only very light voice coil bobbin 11; therefore, the voice coil 12 before separating from the voice coil bobbin 11 has no mass. By the difference in mass, it is possible to obtain a speaker which can reproduce a very high an ultra-high frequency audio signal sound band up to, e.g., 70 kHz having a sound pressure-frequency characteristic as shown in FIG. 5.

Figure 6:
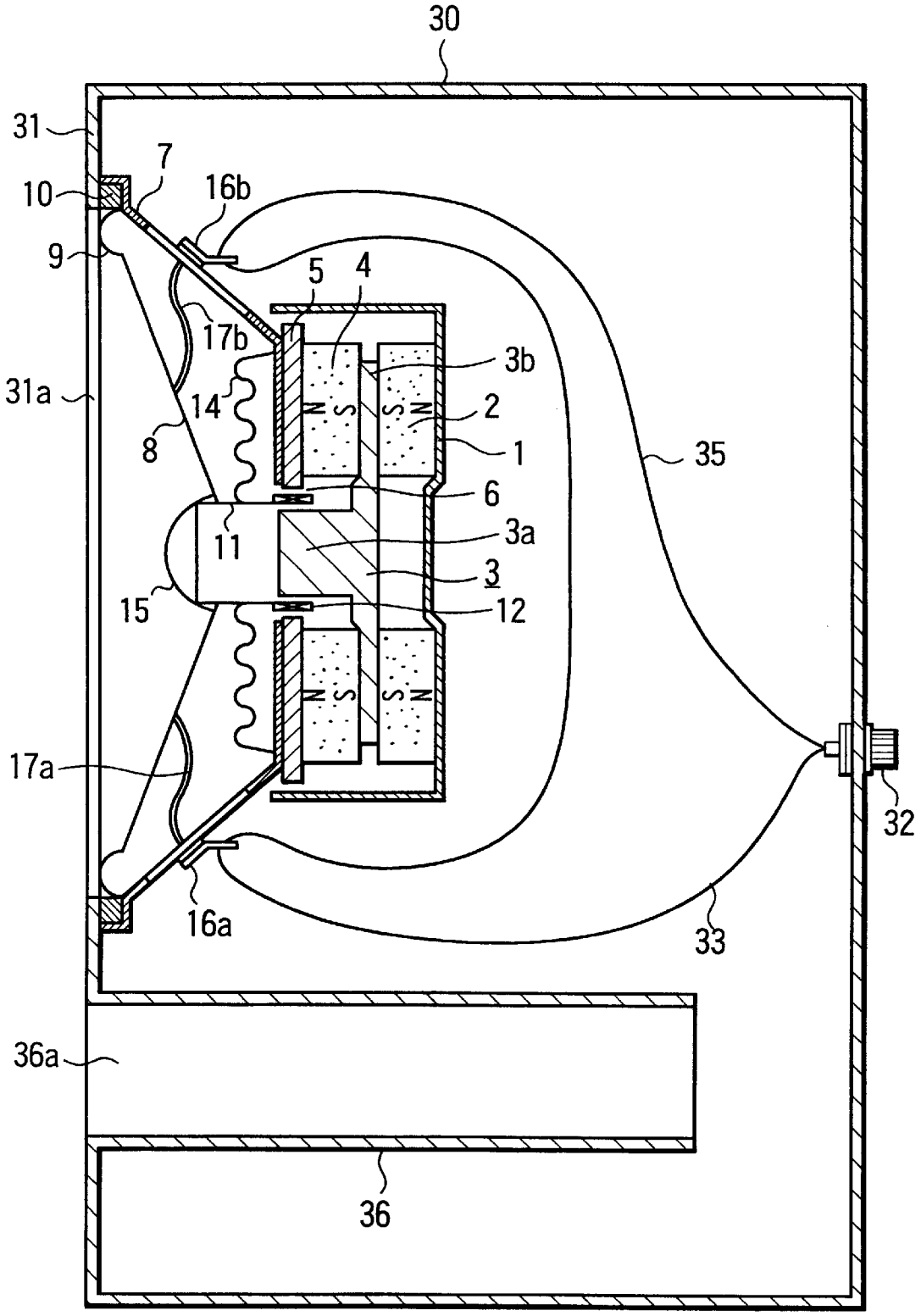
FIG. 6 is a cross sectional view showing a speaker unit.

FIG. 6 shows an example of a phase reverse type speaker unit which is constructed of attaching a wide-band reproducing speaker reproducing a very high an ultra-high frequency audio signal sound band up to 70 kHz shown in FIG. 2 to a small-size speaker box 30. The following is a description on the example shown in FIG. 6. In FIG. 6, the speaker shown in FIG. 2 is fixed so as to face a speaker radiation hole 31*a* which is formed in a baffle plate 31 located on the front surface of a speaker box 30 which is formed like a substantially rectangular box, and is made of an ABS resin or the like.

Moreover, an acoustic signal is supplied to the input terminals 16*a* and 16*b* of the speaker by an input terminal 32 located at a predetermined position on the outside of the speaker box 30 via connecting wires 33 and 34 and 35. Further, the acoustic signal from the input terminal 16*a* is supplied to the voice coil 12 via a cotton-covered wire 17*a* while a high-band signal of the acoustic signal obtained from the input terminal 16*b* being supplied to one-turn voice coil comprising the voice coil bobbin 11 via a cotton-covered wire 17*b*.

A duct 36 having an opening 36*a* is provided on the identical surface to the speaker sound radiation hole 31*a* of the baffle plate 31, and thereby, a sound produced from a back side of the diaphragm 8 of the speaker is inverted in its phase, and then, is radiated to the outside of the speaker box 30 from the duct 36.

In this case, a sound produced from a back side of the diaphragm 8 of the speaker is inverted in its phase, and then, is radiated to the outside of the speaker box 30 from the duct 36, and thereby, it is possible to widen a low an ultra-high frequency audio signal sound band of a sound produced from the front side of the diaphragm 8.

According to a speaker unit of this embodiment, it is possible to obtain a wide-band reproducing speaker which has a small size, and can reproduce a very high an ultra-high frequency audio signal sound band up to, e.g., 70 kHz.

Figure 7:
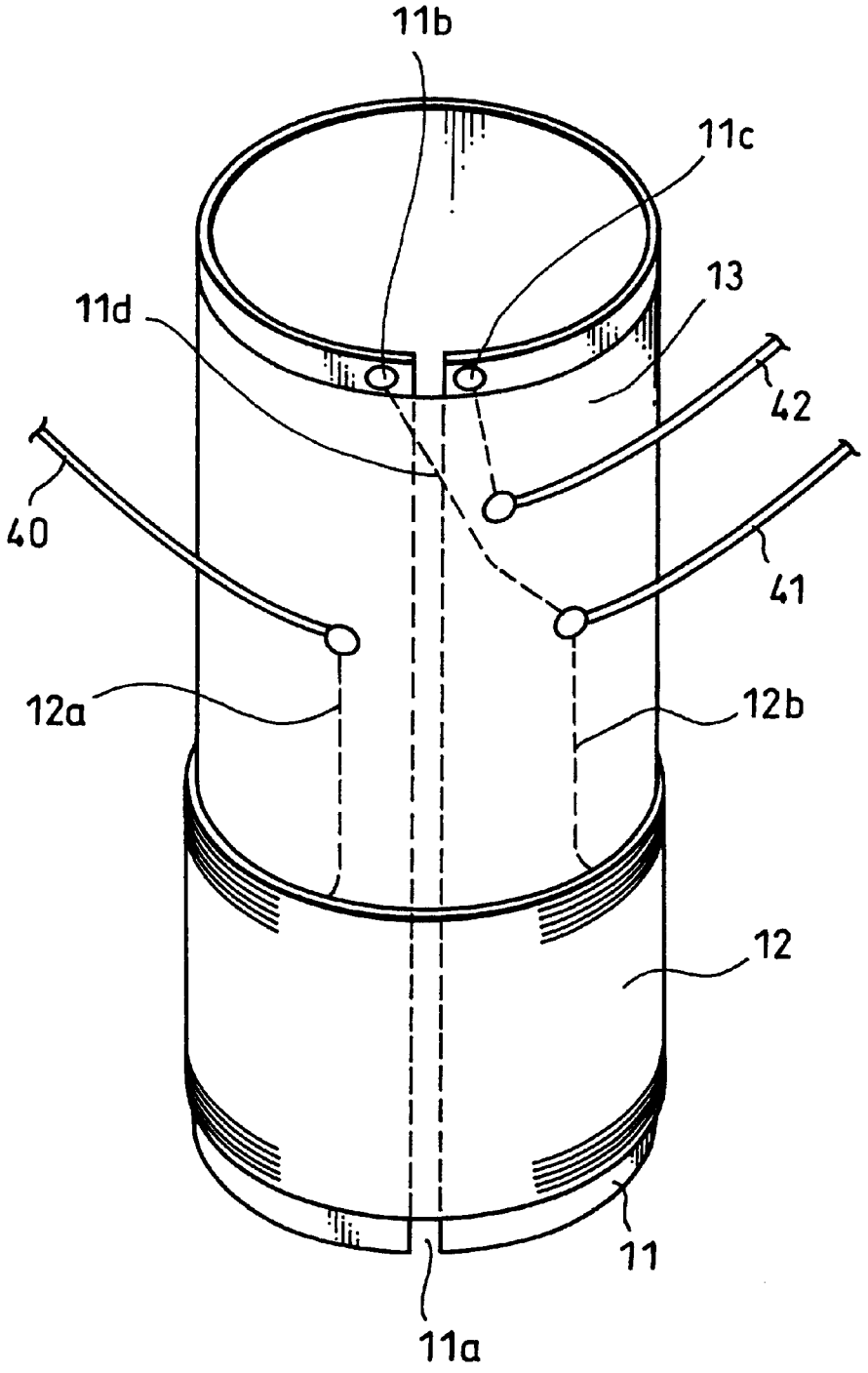
FIG. 7 is a perspective view showing another example of the voice coil used in the speaker of the present invention.
Figure 8:
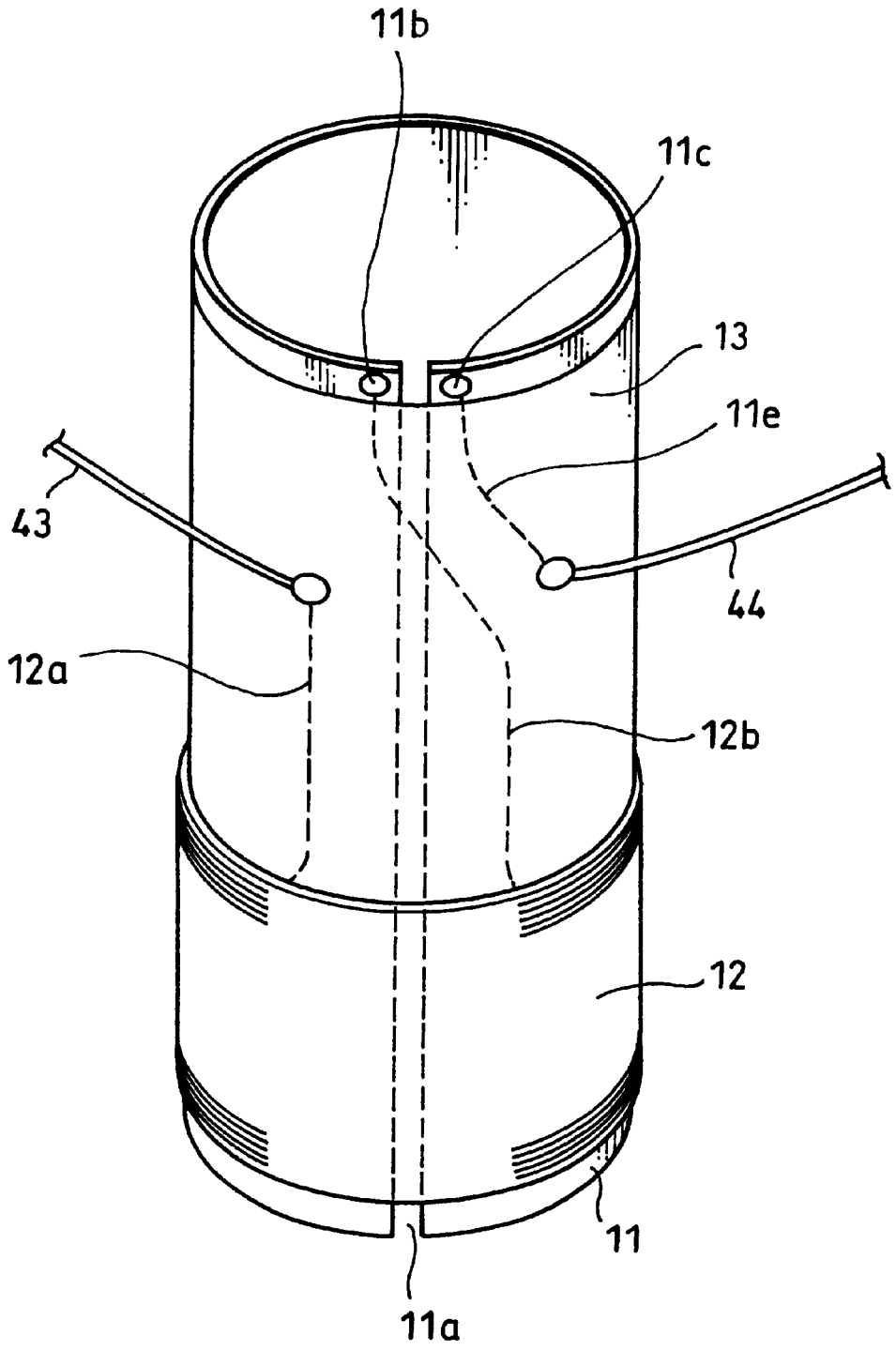
FIG. 8 is a perspective view showing another example of the voice coil used in the speaker of the present invention.
Figure 9:
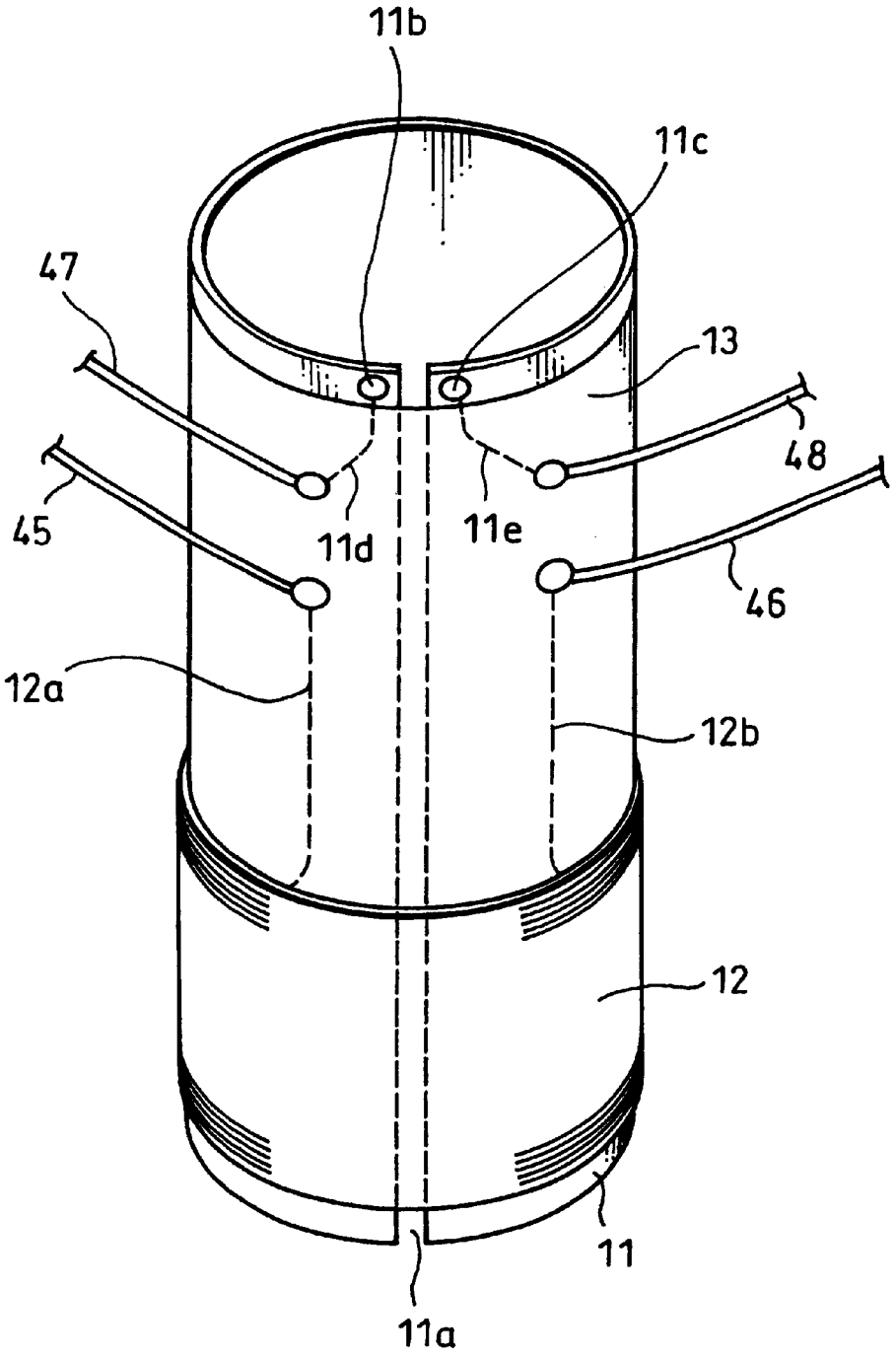
FIG. 9 is a perspective view showing another example of the voice coil used in the speaker of the present invention.

FIG. 7, FIG. 8 and FIG. 9 individually show another example of the voice coil 12 and the voice coil bobbin 11. In these FIG. 7, FIG. 8 and FIG. 9, like reference numerals are used to designate the portions corresponding to FIG. 1, and the details are omitted.

In FIG. 7, the voice coil bobbin 11 is formed of a conductive material, e.g., an aluminum thin film (sheet), and the voice coil bobbin 11 is provided with a gap 11*a* extending to a lengthwise direction as a non-conductive portion. The voice coil bobbin 11 is composed as one-turn voice coil, and input terminals 11*b* and 11*c* are provided on one and the other ends of the voice coil 11, and thus, a high-band signal of the acoustic signal is supplied to these input terminals 11*b* and 11*c*.

For example, a reinforcing paper 13 for reinforcing the voice coil bobbin 11 is wound around an outer periphery of the voice coil bobbin 11 comprising an aluminum thin film, and further, the voice coil 12 is wound around the voice coil bobbin 11, and then, is bonded and fixed thereto.

In the example shown in FIG. 7, a soft bonding agent is used as a bonding agent for bonding and fixing the voice coil 12 to the voice coil bobbin 11. For example, an alcoholic re-activated bonding agent such as a rock varnish is used as the bonding agent.

In the example shown in FIG. 7, three input terminals are provided to the speaker frame 7, and respective one ends of three cotton-covered wires 40, 41 and 42 are connected to these three input terminals, and the other ends of these three cotton-covered wires 40, 41 and 42 are bonded and fixed onto the reinforcing paper 13. End portion of the lead wire 12*a* of the voice coil 12 is soldered and fixed to the other end of the cotton-covered wire 40, and end portion of the lead wire 12*b* of the voice coil 12 is soldered and fixed to the other end of the cotton-covered wire 41. Further, the other end of the lead wire 11*e*, which has one end soldered to the input terminal 11*c* of the voice coil comprising the voice coil bobbin 11, is soldered and fixed to the other end of the cotton-covered wire 42, and the other end of the lead wire 11*d*, which has one end soldered to the input terminal 11*b* of the voice coil comprising the voice coil bobbin 11, is soldered and fixed to the other end of the cotton-covered wire 41.

In this case, a connective relationship between the voice coil 12 and one-turn voice coil comprising the voice coil bobbin 11 is as shown in FIG. 3.

In the example shown in FIG. 8, as the example shown in FIG. 7, two input terminals are provided to the speaker frame 7, and respective one ends of two cotton-covered wires 43 and 44 are connected to these two input terminals, and the other ends of these cotton-covered wires 43 and 44 are bonded and fixed onto the reinforcing paper 13. The end portion of the winding start lead wire 12*a* of the voice coil 12 is soldered and fixed to the other end of the cotton-covered wire 43, and the end portion of the winding termination lead wire 12*b* of the voice coil 12 is connected to one input terminal 11*b* of one-turn the voice coil comprising the voice coil bobbin 11, and further, the other end of the lead wire 11*e*, which has one end soldered and fixed to the other input terminal 11*c* of the voice coil 11, is soldered and fixed to the other end of the cotton-covered wire 44.

In this example shown in FIG. 8, a connective relationship between the voice coil 12 and one-turn voice coil comprising the voice coil bobbin 11 is as shown in FIG. 3. Other construction is the same as the example shown in FIG. 1.

In the example shown in FIG. 9, four input terminals are provided to the speaker frame 7, and respective one ends of four cotton-covered wires 45, 46, 47 and 48 are connected to these four input terminals, and the other ends of these four cotton-covered wires 45, 46, 47 and 48 are bonded and fixed onto the reinforcing paper 13. One and the other ends of the voice coil 12 are connected to the other ends of the cotton-covered wires 45 and 46. Further, the input terminals 11*b* and 11*c* of one-turn voice coil comprising the voice coil bobbin 11 are connected to the other ends of the cotton-covered wires 47 and 48.

In this case, a connective relationship between the voice coil 12 and one-turn voice coil comprising the voice coil bobbin 11 is as shown in FIG. 3. Other construction is the same as the example shown in FIG. 1.

The present invention is not limited to the above embodiments, and of course, other various constructions may be employed without diverging from the scope of the invention.

According to the present invention, the voice coil bobbin is formed of a conductive material, e.g., an aluminum thin film, so as to constitute one-turn voice coil, and a high-band signal of an acoustic signal is supplied thereto, and further, the voice coil is fixed to the voice coil bobbin by a soft bonding agent. Therefore, in a very high an ultra-high frequency audio signal sound band of 40 kHz or more, a bonding strength of the soft bonding agent lowers; as a result, the voice coil bobbin and the voice coil become a state of separating from each other. In this case, the voice coil bobbin is operated as one-turn voice coil, and then, a diaphragm is vibrated by only very light voice coil bobbin, and thereby, the voice coil before separating from the voice coil bobbin has no mass. As a result, by a difference in mass, it is possible to obtain a speaker which can reproduce a very high an ultra-high frequency audio signal sound band up to 70 kHz, for example.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A speaker in which a voice coil bobbin is attached to an inner circumferential portion of a cone shaped diaphragm, a voice coil is wound around the voice coil bobbin, and the voice coil is inserted into a magnetic gap, characterized in that the voice coil bobbin is formed of a conductive material and is formed with a gap extending in a lengthwise direction so as to form a one-turn voice coil, the voice coil is fixed to the voice coil bobbin by a soft bonding agent and a high band signal is supplied to the one-turn voice coil formed of the voice coil bobbin, and the voice coil is connected in parallel with a high band-pass capacitor, and a parallel circuit comprising the voice coil and the capacitor is connected in series with the one-turn voice coil formed of the voice coil bobbin.

* * * * *